US010539893B2

(12) United States Patent
Tanaka et al.

(10) Patent No.: US 10,539,893 B2
(45) Date of Patent: Jan. 21, 2020

(54) TONER

(71) Applicant: CANON KABUSHIKI KAISHA, Tokyo (JP)

(72) Inventors: Maho Tanaka, Tokyo (JP); Kunihiko Nakamura, Gotemba (JP); Kenta Kamikura, Yokohama (JP); Yusuke Kosaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/253,976

(22) Filed: Jan. 22, 2019

(65) Prior Publication Data

US 2019/0235403 A1 Aug. 1, 2019

(30) Foreign Application Priority Data

Jan. 26, 2018 (JP) ..... 2018-011298

(51) Int. Cl.

| | |
|---|---|
| ***G03G 9/08*** | (2006.01) |
| ***G03G 9/097*** | (2006.01) |
| ***G03G 9/087*** | (2006.01) |
| *G03G 9/09* | (2006.01) |

(52) U.S. Cl.

CPC ..... *G03G 9/0825* (2013.01); *G03G 9/0806* (2013.01); *G03G 9/0819* (2013.01); *G03G 9/08755* (2013.01); *G03G 9/09708* (2013.01); *G03G 9/091* (2013.01); *G03G 9/092* (2013.01)

(58) Field of Classification Search

CPC ..... G03G 9/09708
USPC ..... 430/108.3
See application file for complete search history.

(56) References Cited

U.S. PATENT DOCUMENTS

| | | | |
|---|---|---|---|
| 6,001,527 | A | 12/1999 | Ishihara et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |

(Continued)

FOREIGN PATENT DOCUMENTS

| | | |
|---|---|---|
| JP | H08-292599 | 11/1996 |
| JP | H10-186711 | 7/1998 |
| JP | 2016-126196 | 7/2016 |

OTHER PUBLICATIONS

U.S. Appl. No. 16/250,218, Kunihiko Nakamura, filed Jan. 17, 2019.

(Continued)

*Primary Examiner* — Mark A Chapman
(74) *Attorney, Agent, or Firm* — Venable LLP

(57) ABSTRACT

A toner comprising a toner particle comprising a binder resin, wherein a layer comprising an organosilicon condensate is present on the surface of the toner particle; the layer comprising the organosilicon condensate further comprises a reaction product of a compound comprising at least one metal element selected from all the metal elements belonging to Groups 3 to 13, and a polyhydric acid; in a backscattered electron image of the toner captured at a magnification of 50,000 times by using a scanning electron microscope, an average value of an area of the reaction product is from 10 $nm^2$ to 5000 $nm^2$, and a coefficient of variation of the area of the reaction product is not more than 10.0.

9 Claims, 2 Drawing Sheets

(56) References Cited

U.S. PATENT DOCUMENTS

| | | | |
|---|---|---|---|
| 8,142,972 | B2 | 3/2012 | Hotta et al. |
| 8,288,069 | B2 | 10/2012 | Fujikawa et al. |
| 8,828,639 | B2 | 9/2014 | Kamikura et al. |
| 8,986,914 | B2 | 3/2015 | Fujikawa et al. |
| 9,034,549 | B2 | 5/2015 | Shiotari et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,423,708 | B2 | 8/2016 | Tominaga et al. |
| 9,429,860 | B2 | 8/2016 | Kinumatsu et al. |
| 9,594,323 | B2 | 3/2017 | Fujikawa et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,820 | B2 | 11/2017 | Masumoto et al. |
| 9,857,713 | B2 | 1/2018 | Kosaki et al. |
| 9,869,943 | B2 | 1/2018 | Aoki et al. |
| 9,880,478 | B2 | 1/2018 | Shimano et al. |
| 9,897,933 | B2 | 2/2018 | Yoshida et al. |
| 9,921,501 | B2 | 3/2018 | Mochizuki et al. |
| 9,952,523 | B2 | 4/2018 | Shimano et al. |
| 2009/0246675 | A1 | 10/2009 | Nakamura et al. |
| 2010/0028796 | A1 | 2/2010 | Nakamura et al. |
| 2010/0143836 | A1* | 6/2010 | Miyamoto ..... G03G 9/081 430/111.4 |
| 2010/0183971 | A1 | 7/2010 | Fujikawa et al. |
| 2018/0231901 | A1 | 8/2018 | Koji et al. |
| 2018/0246430 | A1 | 8/2018 | Tanaka et al. |
| 2018/0246431 | A1* | 8/2018 | Hashimoto ..... C01G 23/005 |
| 2018/0246432 | A1 | 8/2018 | Nishikawa et al. |
| 2018/0329320 | A1 | 11/2018 | Yoshida et al. |
| 2018/0329321 | A1 | 11/2018 | Nakamura et al. |
| 2018/0329322 | A1 | 11/2018 | Kamikura et al. |
| 2018/0329324 | A1 | 11/2018 | Kamikura et al. |
| 2018/0329325 | A1 | 11/2018 | Hatakeyama et al. |
| 2018/0329327 | A1 | 11/2018 | Yamawaki et al. |
| 2018/0329328 | A1 | 11/2018 | Tanaka et al. |
| 2018/0329329 | A1 | 11/2018 | Nakamura et al. |
| 2018/0329332 | A1 | 11/2018 | Tominaga et al. |

OTHER PUBLICATIONS

U.S. Appl. No. 16/253,999, Kenta Kamikura, filed Jan. 22, 2019.
"Chemical Handbook, Fundamentals, Revised 5th edition", Author: The Chemical Society of Japan, Publisher: Maruzen Publishing House, ISBN: 978-4-621-07341-4 C 3543.

* cited by examiner

TONER

BACKGROUND OF THE INVENTION

Field of the Invention

The present invention relates to a toner for developing an electrostatic image (electrostatic latent image) used in an image forming method such as electrophotography and electrostatic printing.

Description of the Related Art

In recent years, the development of computers and multimedia created a demand for means for on-demand outputting full color images and a need for improvement of performance of copying machines and printers in a wide range of fields from office to home.

For on-demand printing, an increase in the number of prints that can be printed by a toner cartridge is required in order to improve maintainability.

In addition, in order to shorten a print waiting time, it is necessary to shorten a first print out time (FPOT) or first copy out time (FCOT) which is the time until the first printed matter is outputted.

Furthermore, there is a wide range of demands relating to increase in definition of full color images.

In order to shorten the FPOT and FCOT, it is required to improve a charge rising performance of a toner. Further, in order to increase the number of prints that can be printed by a toner cartridge, a toner is required which maintains a high charge rising performance (hereinafter also referred to as charge rising performance maintenance) even in multisheet printing.

Further, for high-definition full-color images, a toner which has high color reproducibility and does not cause toner scattering is required.

Numerous studies have been conducted to meet such requirements.

Japanese Patent Application Laid-open No. H10-186711 discloses a toner in which fine silica particles and fine metal particles are present on the surface of a toner particle in order to improve the charge rising performance of the toner by improving toner flowability and decreasing a resistance value.

In addition, Japanese Patent Application Laid-open No. H08-292599 discloses a method for attaching inorganic fine particles to the toner surface and then coating with a film derived from a silane coupling agent as a method for maintaining the charge rising performance by making it difficult for the fine particles attached to the toner surface to migrate to other members.

Meanwhile, in Japanese Patent Application Laid-open No. 2016-126196, a toner is studied to realize the same polarity for all measurement points on the toner surface by substituting terminal groups of a binder resin and accelerating the reaction conditions of resin synthesis for the purpose of preventing toner scattering.

SUMMARY OF THE INVENTION

As described in Japanese Patent Application Laid-open No. H10-186711, when metal fine particles are attached to the toner surface, the charge rising performance of the initial toner is improved. However, since the metal fine particles sometimes migrate from the toner surface to other members in multisheet printing, the charge rising performance sometimes may not be maintained.

In the toner described in Japanese Patent Application Laid-open No. H08-292599, by coating with a film derived from a silane coupling agent, it is possible to make it difficult for the inorganic fine particles to migrate to other members. However, when a high load is applied to the toner as in a high-speed charging process, the inorganic fine particles may migrate from the toner to other members, and the charge rising performance sometimes may not be maintained.

In addition, Japanese Patent Application Laid-open No. 2016-126196 discloses a method for substituting the terminal of a binder resin with phenoxyacetic acid or benzoic acid so as to realize the same polarity for all the measurement points. However, since the polarity of the toner as a whole increase, toner scattering can be suppressed, but the charge quantity per toner particle sometimes becomes too high. When the charge quantity is too high, the toner laid-on level on the paper decreases, and the color reproducibility of the obtained image deteriorates.

Thus, it has been difficult to provide a toner in which the charge rising performance is maintained at a high level, color reproducibility is high, and toner scattering is suppressed.

That is, the present invention provides a toner in which the charge rising performance is maintained at a high level, color reproducibility is high, and toner scattering is suppressed.

The present invention relates to a toner having a toner particle including a binder resin, wherein a layer including an organosilicon condensate is present on the surface of the toner particle;

the layer including the organosilicon condensate further includes a reaction product of a compound including at least one metal element selected from all the metal elements belonging to Groups 3 to 13, and a polyhydric acid;

in a backscattered electron image of the toner captured at a magnification of 50,000 times by using a scanning electron microscope, an average value of an area of the reaction product is from 10 $nm^2$ to 5000 $nm^2$, and a coefficient of variation of the area of the reaction product is not more than 10.0.

In accordance with the present invention, it is possible to provide a toner in which the charge rising performance is maintained at a high level, color reproducibility is high, and toner scattering is suppressed.

Further features of the present invention will become apparent from the following description of exemplary embodiments with reference to the attached drawings.

DESCRIPTION OF THE EMBODIMENTS

Figure 1:
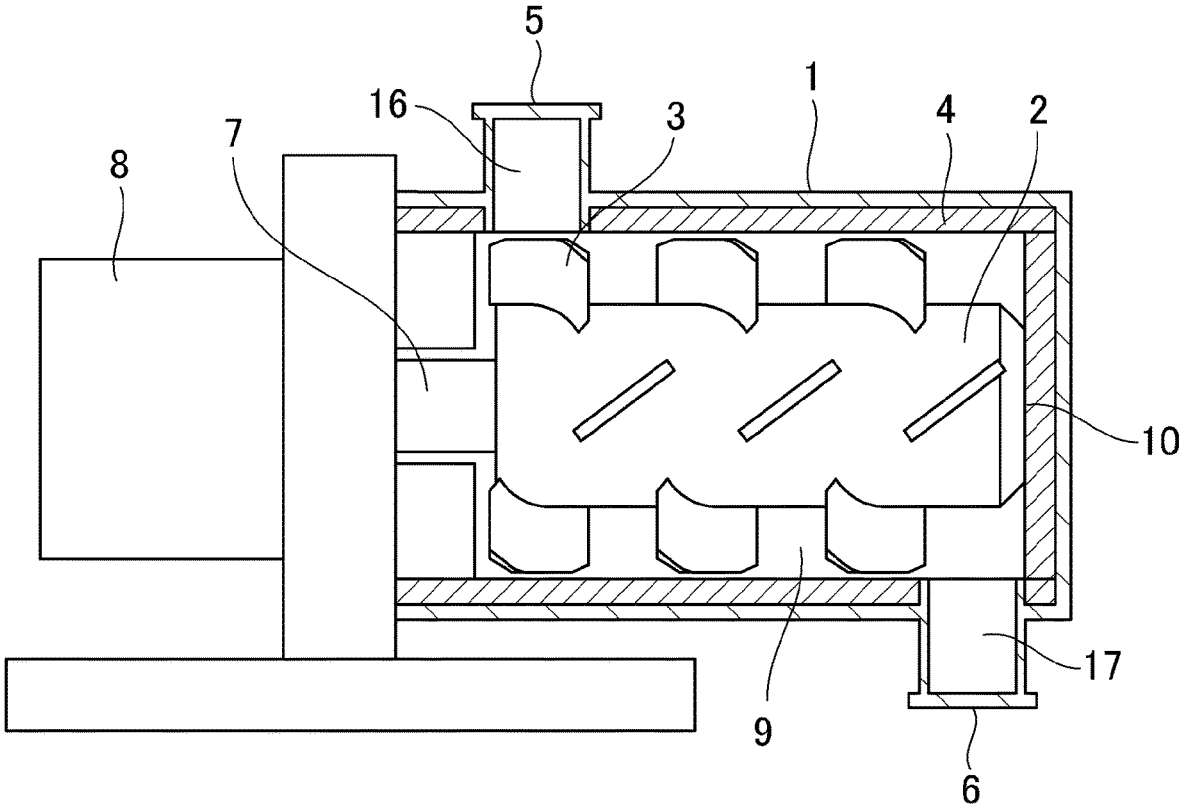
FIG. 1 is a schematic diagram of a mixing process apparatus.

In the present invention, the expressions "AA or more and BB or less" and "from AA to BB" representing a numerical range mean a numerical range including a lower limit and an upper limit which are endpoints unless otherwise specified.

The present invention provides a toner having a toner particle including a binder resin, wherein a layer including an organosilicon condensate is present on the surface of the toner particle;

the layer including the organosilicon condensate further includes a reaction product of a compound including at least one metal element selected from all the metal elements belonging to Groups 3 to 13, and a polyhydric acid;

in a backscattered electron image of the toner captured at a magnification of 50,000 times by using a scanning electron microscope, an average value of an area of the reaction product is from 10 $nm^2$ to 5000 $nm^2$, and a coefficient of variation of the area of the reaction product is not more than 10.0.

The layer including the organosilicon condensate is present on the surface of the toner particle, and the layer including the organosilicon condensate further includes a reaction product of a compound including at least one metal element selected from all the metal elements belonging to Groups 3 to 13, and a polyhydric acid.

Further, in a backscattered electron image of the toner captured at a magnification of 50,000 times by using a scanning electron microscope, the average value of the area of the reaction product is from 10 $nm^2$ to 5000 $nm^2$, preferably from 10 $nm^2$ to 3000 $nm^2$, and more preferably from 10 $nm^2$ to 2000 $nm^2$.

When the average value of the area of the reaction product is not less than 10 $nm^2$, characteristics of the reaction product are easily exerted, so that the reaction product is likely to be charged due to rubbing with other members.

Meanwhile, when the average value of the area of the reaction product is not more than 5000 $nm^2$, since the contact area with the toner particle or the organosilicon condensate becomes sufficiently large, it becomes difficult for the reaction product to migrate from the toner particle to other members.

The coefficient of variation of the area of the reaction product is not more than 10.0, preferably not more than 7.0, and more preferably not more than 5.0.

When the coefficient of variation of the area of the reaction product is not more than 10.0, a ununiformity in size of the reaction product is reduced. As a result, a ununiformity in the charge quantity of the reaction product that is likely to bear a charge is reduced, so that the toner particle is uniformly charged.

Furthermore, when the coefficient of variation is not more than 10.0, it becomes difficult for the reaction product to migrate from the toner particle to other members. The following reason therefor can be suggested.

When the coefficient of variation of the area of the reaction product is larger than 10.0, a ununiformity in the size of the reaction product on the surface of the toner particle is high. In such a case, an external force concentrates on a part of the surface of the toner particle, and the reaction product easily migrates to other members. By contrast, when a ununiformity in the size of the reaction product is low, the external force is dispersed over the entirety of the toner particle, and the migration of the reaction product to other members is suppressed.

A method for adjusting the average value of the area of the reaction product and the coefficient of variation of the area of the reaction product to the above range will be described later.

The "reaction product" is a reaction product of a compound including at least one metal element selected from all the metal elements belonging to Groups 3 to 13, and a polyhydric acid.

The form of the reaction product is preferably fine particles.

That is, the layer including an organosilicon condensate preferably includes fine particles including a reaction product of a compound including at least one metal element selected from all the metal elements belonging to Groups 3 to 13, and a polyhydric acid.

As a result of having a reaction product of a compound including at least one metal element selected from all the metal elements belonging to Groups 3 to 13, and a polyhydric acid on the surface of the toner particle, the resistance value of the toner particle is decreased. In addition, since charge transfer occurs smoothly from the charging member to the toner particle through the compound including the metal element, the toner excels in charge rising performance.

Specific examples of the metal include titanium, zirconium, hafnium, copper, iron, silver, zinc, indium, aluminum, and the like.

In addition, the Pauling electronegativity of the metal element is preferably from 1.25 to 1.85, and more preferably from 1.30 to 1.65.

With a compound including a metal element having an electronegativity within the above-mentioned range, hygroscopicity is suppressed and, in addition thereto, the polarization within the compound is increased, so that the effect on the charge rising performance can be further improved.

As the Pauling electronegativity, the values described in "The Chemical Society of Japan (2004): Chemical Handbook, Fundamentals, Revised 5th edition, the table on the back of the front cover, published by Maruzen Publishing House" were used.

Meanwhile, a compound including only the metal elements of Groups 1 and 2 is unstable, and properties thereof are easily changed by reaction with water in the air and absorption of water in the air. Therefore, the performance tends to change during long-term use.

The polyhydric acid may be any acid as long as it has a valence of not less than 2.

In a reaction product of an acid having a valence of not less than 2 and a compound including the above metal element, a crosslinked structure is formed between the compound and the polyhydric acid, the movement of electrons is promoted by the crosslinked structure, and the charge rising performance is improved.

Specific examples of the polyhydric acid are presented hereinbelow.

Inorganic acids such as phosphoric acid, carbonic acid, sulfuric acid and the like; organic acids such as dicarboxylic acids, tricarboxylic acids and the like.

Specific examples of the organic acids are presented hereinbelow.

Dicarboxylic acids such as oxalic acid, malonic acid, succinic acid, glutaric acid, adipic acid, fumaric acid, maleic acid, pimelic acid, suberic acid, azelaic acid, sebacic acid, phthalic acid, isophthalic acid, terephthalic acid and the like.

Tricarboxylic acids such as citric acid, aconitic acid, trimellitic anhydride and the like.

Among them, it is preferable that a polyhydric acid be at least one selected from the group consisting of carbonic acid, sulfuric acid, and phosphoric acid because such acids strongly react with a compound including a metal element and are unlikely to absorb moisture. More preferably, the polyhydric acid is phosphoric acid.

The polyhydric acid may be used as it is, or as an alkali metal salt of the polyhydric acid with sodium, potassium, lithium or the like; an alkaline earth metal salt with magnesium, calcium, strontium, barium or the like; or an ammonium salt of the polyhydric acid.

Examples of the compound including the metal element include metal alkoxides such as tetraisopropyl titanate and the like and metal chelates such as titanium lactate and the like.

Specific examples of the reaction product of the polyhydric acid and the compound including the metal element are presented hereinbelow.

Metal salts of phosphoric acid such as a reaction product of phosphoric acid and a compound including titanium, a reaction product of phosphoric acid and a compound including zirconium, a reaction product of phosphoric acid and a compound including aluminum, a reaction product of phosphoric acid and a compound including copper, a reaction product of phosphoric acid and a compound including iron and the like; metal salts of sulfuric acid such as a reaction product of sulfuric acid and a compound including titanium, a reaction product of sulfuric acid and a compound including zirconium, a reaction product of sulfuric acid and a compound including silver and the like; and metal salts of carbonic acid such as a reaction product of carbonic acid and a compound including titanium, a reaction product of carbonic acid and a compound including zirconium, a reaction product of carbonic acid and a compound including iron and the like.

Among them metal salts of phosphoric acid and metal salts of carbonic acid are preferred.

Among them, metal salts of phosphoric acid are preferable because of a high strength increased by phosphate ion cross-linking between metals and also because of excellent charge rising performance due to the presence of ionic bond in the molecule.

More specifically, it is preferable that at least one selected from the group consisting of a reaction product of phosphoric acid and a compound including titanium, a reaction product of phosphoric acid and a compound including zirconium, and a reaction product of phosphoric acid and a compound including aluminum be included.

The organosilicon condensate is obtained by condensing an organosilicon compound as a raw material by various methods.

Since the toner particle has a layer of an organosilicon condensate on the surface, the reaction product of the polyhydric acid and the compound including the metal element can rapidly transfer the charge generated by charging caused by rubbing against the charging member to the entire toner particle.

It is conceivable that this improves the charge rising performance.

In addition, the organosilicon condensate is bonded with the reaction product of the polyhydric acid and the compound including the metal element, thereby making it difficult for the reaction product to migrate from the toner particle to another member.

The reason for this is believed to be that the carboxyl group of the polyhydric acid contained in the reaction product is bonded to the silanol of the organosilicon condensate.

Since the organosilicon condensate does not need to cover the entire toner particle, the organosilicon condensate may be present continuously or discontinuously on the surface of the toner particle.

Since a layer including the organosilicon condensate including the reaction product is present on the surface of the toner particle and the average value of the area of the reaction product and the coefficient of variation of the area of the reaction product are controlled within the abovementioned ranges, the charge rising performance is markedly improved and the charging uniformity is maintained over a long period of time.

As a result, occurrence of toner scattering and fogging is suppressed even in multisheet printing. Further, the charge quantity per one toner particle does not become too high, the decrease in the laid-on level on the paper is suppressed, and excellent color reproducibility is obtained.

The content of Si element on the surface of the toner particle measured by X-ray photoelectron spectroscopy is preferably from 0.1 atomic % to 40.0 atomic %.

The content of the Si (silicon) element is more preferably from 0.5 atomic % to 30.0 atomic %, and still more preferably from 1.0 atomic % to 20.0 atomic %.

When the content of the Si element is not less than 0.1 atomic %, the reaction product of the polyhydric acid and the compound including the metal element is unlikely to migrate from the toner particle to another member.

Meanwhile, when the content of the Si element is not more than 40.0 atomic %, the reaction product of the polyhydric acid and the compound including the metal element is appropriately exposed on the surface of the toner particle, thereby facilitating charging by rubbing against other members.

The content of the Si element on the surface of the toner particle can be controlled by the addition amount of the organosilicon compound in the production of the toner particle.

The organosilicon condensate is preferably a condensate of at least one organosilicon compound selected from the group consisting of organosilicon compounds represented by a following formula (1).

Among them, it is preferable to use an organosilicon compound in which n in the formula (1) is an integer of 2 to 4, because the organosilicon condensate is formed by siloxane bonds.

$$Ra_{(n)}\text{-Si-}Rb_{(4-n)} \quad (1)$$

In the formula (1), each Ra independently represents a halogen atom or an alkoxy group (preferably having 1 to 4 carbon atoms, more preferably 1 to 3 carbon atoms), each Rb independently represents an alkyl group (preferably having 1 to 8 carbon atoms, more preferably 1 to 6 carbon atoms), an alkenyl group (preferably having 1 to 6 carbon atoms, more preferably 1 to 4 carbon atoms), an acyl group (preferably having 1 to 6 carbon atoms, more preferably 1 to 4 carbon atoms), an aryl group (preferably having 6 to 14 carbon atoms, more preferably 6 to 10 carbon atoms), or a methacryloxyalkyl group (preferably a methacryloxypropyl group), and n represents an integer of 1 to 4 (preferably 2 to 4).

Specific examples of the organosilicon compound represented by the formula (1) include monofunctional to tetrafunctional organosilicon compounds.

Examples of monofunctional organosilicon compounds include trimethylethoxysilane, triethylmethoxysilane, triethylethoxysilane, triisobutylmethoxysilane, triisopropylmethoxysilane, tri-2-ethylhexylmethoxysilane and the like.

Examples of the bifunctional organosilicon compounds include dimethyldimethoxysilane, dimethyldiethoxysilane and the like.

Examples of the trifunctional organosilicon compounds include the following compounds.

Trifunctional alkyl group-containing silane compounds such as methyltrimethoxysilane, methyltriethoxysilane, methyldiethoxymethoxysilane, methylethoxydimethoxysilane;

ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, octadecyltrimethoxysilane, octadecyltriethoxysilane and the like;

trifunctional alkenyl group-containing silane compounds such as vinyltrimethoxysilane, vinyltriethoxysilane, allyltrimethoxysilane, allyltriethoxysilane and the like;

trifunctional aryl group-containing silane compounds such as phenyltrimethoxysilane, phenyltriethoxysilane and the like;

trifunctional methacryloxyalkyl group-containing silane compounds such as γ-methacryloxypropyltrimethoxysilane, γ-methacryloxypropyltriethoxysilane, γ-methacryloxypropyldiethoxymethoxysilane, γ-methacryloxypropylethoxydimethoxysilane and the like.

Examples of tetrafunctional organosilicon compounds include tetramethoxysilane, tetraethoxysilane, tetrapropoxysilane, tetrabutoxysilane and the like.

Two or more kinds of organosilicon compounds may be used in combination. The organosilicon compounds to be used in combination are not particularly limited, and examples thereof include organosilicon compounds represented by the formula (1).

The toner particle includes a binder resin.

Examples of the binder resin include a vinyl resin, a polyester resin, a polyurethane resin, a polyamide resin and the like.

Examples of polymerizable monomers which can be used for producing the vinyl resin include styrene type monomers such as styrene, α-methylstyrene and the like;

acrylic acid esters such as methyl acrylate, butyl acrylate and the like;

methacrylic acid esters such as methyl methacrylate, 2-hydroxyethyl methacrylate, t-butyl methacrylate, 2-ethylhexyl methacrylate and the like;

unsaturated carboxylic acids such as acrylic acid, methacrylic acid and the like;

unsaturated dicarboxylic acids such as maleic acid and the like;

unsaturated dicarboxylic anhydrides such as maleic anhydride and the like;

nitrilovinyl monomers such as acrylonitrile and the like; halogen-containing vinyl monomers such as vinyl chloride and the like;

nitrovinyl monomers such as nitrostyrene and the like; and the like.

Among them, it is preferable to include a vinyl resin and a polyester resin as the binder resin.

In the case of obtaining a binder resin by an emulsion aggregation method, a suspension polymerization method or the like, a conventionally known monomer can be used as the polymerizable monomer without particular limitation.

Specifically, the abovementioned vinyl type monomers can be used.

As the polymerization initiator, a known polymerization initiator can be used.

Specific examples thereof are presented hereinbelow.

Peroxide-type polymerization initiators such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxydicarbonate, tetralin hydroperoxide, 1-phenyl-2-methylpropyl-1-hydroperoxide, tert-hydroperoxide pertriphenylacetate, tert-butyl performate, tert-butyl peracetate, tert-butyl perbenzoate, tert-butyl perphenylacetate, tert-butyl permethoxyacetate, tert-butylbenzoyl peroxide per-N-(3-toluyl) palmitate, t-butyl peroxy-2-ethyl hexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, lauroyl peroxide and the like;

azo- or diazo-type polymerization initiators such as 2,2'-azobis (2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, azobisisobutyronitrile, and the like; and the like.

The toner particle may include a colorant.

As the colorant, conventionally known pigments and dyes of black, yellow, magenta and cyan colors, pigments and dyes of other colors, magnetic bodies and the like can be used.

As the black colorant, black pigments typified by carbon black and the like can be used.

Examples of yellow colorants include yellow pigments and yellow dyes such as monoazo compounds; disazo compounds; condensed azo compounds; isoindolinone compounds; benzimidazolone compounds; anthraquinone compounds; azo metal complexes; methine compounds; allylamide compounds and the like.

Specific examples include C. I. Pigment Yellow 74, 93, 95, 109, 111, 128, 155, 174, 180, 185, C. I. Solvent Yellow 162, and the like.

Examples of magenta colorants include magenta pigments and magenta dyes such as monoazo compounda; condensed azo compounds; diketopyrrolopyrrole compounds; anthraquinone compounds; quinacridone compounds; basic dye lake compounds; naphthol compounds; benzimidazolone compounds; thioindigo compounds; perylene compounds and the like.

Specific examples include C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, C. I. Pigment Bio Red 19 and the like.

Examples of cyan colorants include cyan pigments and cyan dyes such as copper phthalocyanine compounds and derivatives thereof, anthraquinone compounds, basic dye lake compounds and the like.

Specific examples include C. I. Pigment Blue 1, 7, 15, 15:1, 15:2, 15:3, 15:4, 60, 62, 66 and the like.

The amount of the colorant is preferably from 1.0 part by mass to 20.0 parts by mass with respect to 100.0 parts by mass of the binder resin or the polymerizable monomer.

In addition, it is also possible to produce a magnetic toner by including a magnetic body.

In this case, the magnetic body may serve as a colorant.

Examples of the magnetic body include iron oxides typified by magnetite, hematite, ferrite and the like; metals typified by iron, cobalt, nickel or the like, alloys of these metals with metals such as aluminum, cobalt, copper, lead, magnesium, tin, zinc, antimony, beryllium, bismuth, cadmium, calcium, manganese, selenium, titanium, tungsten, vanadium, and the like and mixtures thereof.

The toner particle may include wax. Examples of the wax are presented hereinbelow.

Esters of monohydric alcohols and monocarboxylic acids such as behenyl behenate, stearyl stearate, palmityl palmitate and the like;

esters of divalent carboxylic acids and monoalcohols such as dibehenyl sebacate and the like;

esters of dihydric alcohols and monocarboxylic acids such as hexanediol dibehenate and the like;

esters of trihydric alcohols monocarboxylic acids such as glycerin tribehenate and the like;

esters of tetrahydric alcohols and monocarboxylic acids such as pentaerythritol tetrastearate, pentaerythritol tetrapalmitate and the like;

esters of hexahydric alcohols with monocarboxylic acids such as dipentaerythritol hexastearate, dipentaerythritol hexapalmitate and the like;

esters of polyfunctional alcohols and monocarboxylic acid such as polyglycerol behenates and the like; natural ester waxes such as carnauba, rice wax and the like;

petroleum hydrocarbon waxes and derivatives thereof such as paraffin wax, microcrystalline wax, petrolatum and the like;

hydrocarbon waxes and derivatives thereof obtained by the Fischer-Tropsch process;

polyolefin hydrocarbon waxes such as polyethylene wax and polypropylene wax and derivatives thereof; higher aliphatic alcohols;

fatty acids such as stearic acid, palmitic acid and the like; acid amide waxes and the like.

From the viewpoint of release property, the amount of the wax is preferably from 1.0 part by mass to 30.0 parts by mass, and more preferably from 5.0 parts by mass to 20.0 parts by mass with respect to 100.0 parts by mass of the binder resin or the polymerizable monomer.

The toner particle may include a charge control agent. As the charge control agent, conventionally known charge control agents can be used.

Specific examples of negative charge control agents include metal compounds of aromatic carboxylic acids such as salicylic acid, alkylsalicylic acids, dialkylsalicylic acids, naphthoic acid, dicarboxylic acids or the like, or polymers or copolymers including metal compounds of aromatic carboxylic acids;

a polymer or copolymer having a sulfonic acid group, a sulfonic acid salt group or a sulfonic acid ester group;

a metal salt or metal complex of an azo dye or an azo pigment;

a boron compound, a silicon compound, a calixarene, and the like.

Meanwhile, examples of positive charge control agents include quaternary ammonium salts and polymer-type compounds having a quaternary ammonium salts in a side chain; guanidine compounds; nigrosine compounds; imidazole compounds and the like.

Examples of polymers or copolymers having a sulfonic acid salt group or a sulfonic acid ester group include homopolymers of sulfonic acid group-containing vinyl monomers such as styrenesulfonic acid, 2-acrylamido-2-methylpropanesulfonic acid, 2-methacrylamido-2-methylpropanesulfonic acid, vinylsulfonic acid, methacrylsulfonic acid and the like, and copolymers of vinyl monomers listed in the section on the binder resin and the sulfonic acid group-containing vinyl monomers.

The amount of the charge control agent is preferably from 0.01 parts by mass to 5.0 parts by mass with respect to 100.0 parts by mass of the binder resin or the polymerizable monomer.

When the toner particle has a layer including the organosilicon condensate and this layer includes the reaction product of the polyhydric acid and the compound including the metal element, excellent characteristics such as flowability are demonstrated even when there is no external additive.

However, for the purpose of further improvement, an external additive may be also included.

As the external additive, conventionally known external additives can be used without particular limitations.

Specific examples include silica fine particles such as raw material silica fine particles such as wet-method silica, dry-method silica and the like or these raw material silica fine particles subjected to surface treatment with a treatment agent such as a silane coupling agent, a titanium coupling agent, silicone oil or the like; resin fine particles such as vinylidene fluoride fine particles, polytetrafluoroethylene fine particles and the like.

The amount of the external additive is preferably from 0.1 parts by mass to 5.0 parts by mass with respect to 100.0 parts by mass of the toner particle.

A method for preparing a toner will be described hereinbelow.

The method for producing toner particle is not particularly limited, and can be exemplified by the following production method.

A toner base particle is prepared, and the reaction product of the polyhydric acid and the compound including the metal element (hereinafter also simply referred to as "reaction product") is attached to the toner base particle.

Thereafter, the toner base particle is covered with the organosilicon condensate.

When such production method is used, the average value of the area of the reaction product and the coefficient of variation of the area of the reaction product can be easily adjusted to the above ranges.

More specifically, the average value of the area of the reaction product and the coefficient of variation of the area of the reaction product can be controlled by the addition amount of the compound including the metal element, reaction temperature, reaction pH, and type, addition amount, and addition period of the organosilicon compound forming the organosilicon condensate at the time of producing the reaction product of the polyhydric acid and the compound including the metal element.

The attachment of the reaction product and covering with the organosilicon condensate may be carried out simultaneously or separately. The details will be described below, but they are not limiting.

The method for preparing the toner base particle is not particularly limited, and a suspension polymerization method, a dissolution suspension method, an emulsion aggregation method, a pulverization method, or the like can be used.

When the toner base particles are produced in an aqueous medium, the particles may be used as such as an aqueous dispersion, or may be redispersed in an aqueous medium after washing, filtration and drying.

When toner base particles are produced by a dry method, they can be dispersed in an aqueous medium by a known method. In order to disperse the toner base particles in the aqueous medium, it is preferable that the aqueous medium include a dispersion stabilizer.

As an example, a method for producing a toner base particle by a suspension polymerization method will be described hereinbelow.

First, a polymerizable monomer capable of forming a binder resin and, if necessary, various additives are mixed, and a polymerizable monomer composition is prepared by dissolving or dispersing the materials by using a dispersing machine.

Various additives include a colorant, wax, a charge control agent, a polymerization initiator, a chain transfer agents and the like.

The dispersing machine can be exemplified by a homogenizer, a ball mill, a colloid mill, or an ultrasonic dispersing machine.

Subsequently, the polymerizable monomer composition is placed in an aqueous medium including poorly water-soluble inorganic fine particles, and droplets of the polymerizable monomer composition are prepared using a high-speed dispersing machine such as a high-speed stirrer or an ultrasonic dispersing machine (granulation step).

Thereafter, the polymerizable monomers in the droplets is polymerized to obtain toner base particles (polymerization step).

The polymerization initiator may be mixed at the time of preparing the polymerizable monomer composition or may be mixed in the polymerizable monomer composition just before droplets are formed in the aqueous medium.

In addition, the polymerization initiator can also be added, if necessary, in a state of being dissolved in a polymerizable monomer or other solvent during granulation of the droplets or after completion of granulation, that is, immediately before the start of the polymerization reaction.

After obtaining the binder resin by polymerizing the polymerizable monomer, desolvation treatment may be carried out as necessary to obtain a dispersion liquid of the toner base particles.

Methods for uniformly attaching fine particles including the reaction product of the polyhydric acid and the compound including the metal element to the toner base particle are exemplified below.

A first method is a method for attaching to the surface of the toner base particle simultaneously with the formation of the reaction product.

A second method is a method for producing fine particles including the reaction product and then attaching the produced fine particles to the surface of the toner base particle while disintegrating.

More specifically, (1) in an aqueous medium in which toner base particles are dispersed, the compound including the metal element is reacted with the polyhydric acid to precipitate fine particles including the reaction product, and to attach the fine particles to the surface of the toner base particles.

For example, where the compound including the metal element and the polyhydric acid are added to a dispersion liquid of toner base particles and the components are mixed, the compound including the metal element is reacted with the polyhydric acid to precipitate the reaction product, and where the dispersion is stirred at the same time, the reaction product is attached to the toner base particles.

(2) Fine particles including the reaction product obtained by reacting the compound including the metal element with the polyhydric acid are attached to the surface of the toner base particles while disintegrating.

For example, the fine particles including the reaction product are attached to the toner base particles while applying a force disintegrating the fine particles by using a high-speed stirrer that applies a shearing force to the powder, such as FM MIXER, MECHANO HYBRID (manufactured by Nippon Coke & Engineering Co., Ltd.), SUPER MIXER, NOBILTA (Hosokawa Micron Corporation), and the like.

Meanwhile, a method for forming the layer including the organosilicon condensate on the surface of the toner particle is not particularly limited, and can be exemplified by the following two methods.

(1) A method for forming the layer on the toner base particle by adding and condensing an organosilicon compound in an aqueous medium.

(2) A method for forming the layer of the organosilicon condensate by spraying a solvent including an organosilicon compound onto the surface of the toner base particle by a spray drying method, polymerizing the surface with hot air, and then drying.

Among them, a method for forming the layer on the toner base particle by adding and condensing an organosilicon compound in an aqueous medium is preferable from the viewpoint of layer uniformity.

This method will be described in detail hereinbelow.

The organosilicon compound can be added to and mixed with the aqueous medium by any method.

For example, the organosilicon compound may be added as it is.

Further, it may be added after mixing with an aqueous medium and hydrolysis.

The temperature at the time of condensation of the organosilicon compound is preferably from about 10° C. to about 100° C.

Furthermore, it is known that the condensation of organosilicon compounds has pH dependence. It is preferable to condense the organosilicon compound to form a layer by adjusting the pH of the aqueous medium to from 7.0 to 12.0.

The pH of the aqueous medium may be adjusted with a known acid or base. Examples of the acid for adjusting the pH are presented hereinbelow.

Hydrochloric acid, hydrobromic acid, iodic acid, perbromic acid, metaperiodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, aspartic acid, o-aminobenzoic acid, p-aminobenzoic acid, isonicotinic acid, oxaloacetic acid, citric acid, 2-glycerol phosphoric acid, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, malonic acid.

Examples of the base for adjusting the pH are presented hereinbelow.

Alkali metal hydroxides such as potassium hydroxide, sodium hydroxide, lithium hydroxide and the like and aqueous solutions thereof, alkali metal carbonates such as potassium carbonate, sodium carbonate, lithium carbonate and the like and aqueous solutions thereof, alkali metal sulfates such as potassium sulfate, sodium sulfate, lithium sulfate and aqueous solutions thereof, alkali metal phosphates such as potassium phosphate, sodium phosphate, lithium phosphate and the like and aqueous solutions thereof, alkaline earth metal hydroxides such as calcium hydroxide, magnesium hydroxide and the like and aqueous solutions thereof, basic amino acids such as ammonia, histidine, arginine, lysine and the like and aqueous solutions thereof, and trishydroxymethylaminomethane.

These acids and bases may be used singly or in combination of two or more thereof.

Examples of the aqueous medium include water, alcohols such as methanol, ethanol, propanol and the like and mixed solvents thereof.

Methods for measuring each physical property value will be described below.

Method for Measuring Weight Average Particle Diameter (D4) and Number Average Particle Diameter (D1)

The number average particle diameter (D1) and weight average particle diameter (D4) of toner, toner particle, or toner base particles (hereinafter also referred to as toner) are calculated in the following manner.

A precision particle diameter distribution measuring device "Coulter Counter Multisizer 3" (manufactured by Beckman Coulter, Inc.) equipped with a 100-μm aperture tube and based on a pore electric resistance method is used as a measurement device.

The measurement conditions are set and measurement data are analyzed using the dedicated software "Beckman Coulter Multisizer 3 Version 3.51" (manufactured by Beckman Coulter, Inc.). The measurement is performed with 25,000 effective measurement channels.

A solution prepared by dissolving special grade sodium chloride in ion exchanged water to a concentration of 1%, for example, "ISOTON II" (manufactured by Beckman Coulter, Inc.), can be used as the electrolytic aqueous solution to be used for the measurement.

The dedicated software is set up in the following manner before the measurement and analysis.

The total count number in a control mode is set to 50,000 particles on a "CHANGE STANDARD MEASUREMENT METHOD (SOMME)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "MEASUREMENT BUTTON OF THE THRESHOLD/NOISE LEVEL". Further, the current is set to 1600 μA, the gain is set to 2, the electrolytic solution is set to ISOTON II, and "FLUSH OF APERTURE TUBE AFTER MEASUREMENT" is checked.

On the "PULSE TO PARTICLE DIAMETER CONVERSION SETTING" screen of the dedicated software, the bin interval is set to a logarithmic particle diameter, the particle diameter bin is set to a 256-particle diameter bin, and the particle diameter range is set from 2 μm to 60 μm.

A specific measurement method is described hereinbelow.

(1) 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "FLUSH OF APERTURE TUBE" function of the dedicated software.

(2) A total of 30 ml of the electrolytic aqueous solution is placed in a glass 100 mL flat-bottom beaker. Then, 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent to the beaker.

(3) An ultrasonic disperser "Ultrasonic Dispersion System Tetra 150" (manufactured by Nikkaki Bios Co., Ltd.) with an electrical output of 120 W in which two oscillators with an oscillation frequency of 50 kHz are built in with a phase shift of 180 degrees is prepared. A total of 3.3 L of ion exchanged water is poured in the water tank of the ultrasonic disperser and 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) A total of 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be 5%. Then, measurement is conducted until the number of particles to be measured reaches 50,000.

(7) The measurement data are analyzed with the dedicated software provided with the device, and the number average particle diameter (D1) and the weight average particle diameter (D4) are calculated. The "AVERAGE DIAMETER" on the "ANALYSIS/VOLUME STATISTICAL VALUE (ARITHMETIC MEAN)" screen obtained when the graph/(% by volume) is set in the dedicated software is the weight average particle diameter (D4), and the "AVERAGE DIAMETER" on the "ANALYSIS/NUMBER STATISTICAL VALUE (ARITHMETIC MEAN)" screen obtained when the graph/(% by number) is set in the dedicated software is the number average particle diameter (D1).

Observation Method of Surface of Toner Particle

The surface of the toner particle is observed in the following manner.

The surface of the toner is observed using a scanning electron microscope (SEM, device name: JSM-7800F, manufactured by JEOL Ltd.) at a magnification of 50,000 times.

Then, mapping of elements on the surface of the toner particle is performed using the EDX (Energy Dispersive X-ray Spectroscopy).

Based on the obtained element mapping image of the SEM, the presence of the layer including the organosilicon condensate on the surface of the toner particle, and the presence of the reaction product of the polyhydric acid and the compound including the metal element in the layer are confirmed.

Specifically, the mapping image of the metal element and the mapping image of the element contained in a polyhydric acid, for example, the mapping image of phosphorus when phosphoric acid is used as a polyhydric acid, are compared, and when the two mapping images match, it is confirmed that the reaction product of the compound including the metal element and the polyhydric acid is present.

Next, the mapping image of the silicon element and the mapping image of the metal element or the mapping image of the element contained in the polyhydric acid are compared. It is confirmed that the layer including the organosilicon condensate includes the reaction product when the silicon element is present in the place where the metal element and the element contained in the polyhydric acid are present.

Method for Calculating Average Area of Reaction Product and Coefficient of Variation of Area of Reaction Product (A) the Average Value of the Area of the Reaction Product is Calculated in the Following Manner.

(1) Observation Using JSM-7800F

When calculating the average value of the area of the reaction product, JSM-7800F is used to obtain a SEM image (backscattered electron image). The observation conditions are described below.

"PC-SEM" of JSM-7800F is started, a sample holder is inserted into a sample chamber of a JSM-7800F housing, and the sample holder is moved to an observation position.

On the screen of the PC-SEM, the acceleration voltage is set to [1.0 kV] and the observation magnification is set to [50,000]. The [ON] button of an observation icon is pressed, the acceleration voltage is applied, and the backscattered electron image is observed.

(2) Calculation of Average Value of Area of Reaction Product

The resulting backscattered electron image is read into an image processing and analyzing device LUZEX AP (manufactured by Nireco Corporation) and monochromatically displayed.

After averaging processing, binarization processing is performed to obtain a binarized image in which the reaction product is represented in white. After that, the average value of the area of the white part is obtained by a built-in function and the resulting value is taken as the average value of the area of the reaction product.

(B) Calculation of Coefficient of Variation of Area of Reaction Product

The backscattered electron image is read into the image processing and analyzing device LUZEX AP (manufactured by Nireco Corporation) and monochromatically displayed.

After averaging processing, binarization processing is performed to obtain a binarized image in which the reaction product is represented in white. After that, the standard deviation of the area of the white part is obtained by a built-in function and divided by the average value of the area of the reaction product. The obtained value is taken as the coefficient of variation of the area of the reaction product.

Method for Calculating Content of Si Element on Toner Particle Surface

The content (atomic %) of Si element on the toner particle surface is calculated by performing surface composition analysis by X-ray photoelectron spectroscopy (ESCA).

In the case where an external additive is present in the toner, the following treatment is carried out to obtain toner particle from which the external additive has been removed, and then the surface composition analysis is carried out.

The toner is placed in isopropanol and vibrated for 10 min with an ultrasonic washer.

Thereafter, the toner particle and the solution are separated with a centrifugal separator (1000 rpm for 5 min). The supernatant liquid is separated, and the precipitated toner particle are dried by vacuum drying to obtain toner particle from which the external additive has been removed.

The device for ESCA and measurement conditions are as follows.

Device used: Quantum 2000 manufactured by ULVAC-PHI

X-ray photoelectron spectrometer measurement conditions:

X-ray source Al Kα

X-rays: 100 μm, 25 W, 15 kV

Raster: 300 μm×200 μm

Pass energy: 58.70 eV

Step size: 0.125 eV

Neutralizing electron gun: 20 μA, 1 V

Ar ion gun: 7 mA, 10 V

Sweep number: Si 15 times, C 10 times, O 10 times, Ti 40 times

Based on the measured peak intensity of each element, the content (atomic %) of Si element is calculated using the relative sensitivity factor provided by PHI company.

EXAMPLES

Hereinafter, the present invention will be described in greater detail by way of Examples and Comparative Examples, but the present invention is not limited thereto. "Parts" and "%" described in the Examples and Comparative Examples are all on a mass basis unless otherwise specified.

Production Example of Organosilicon Compound Liquid 1

| | |
|---|---|
| Ion exchanged water | 90.0 parts |
| Methyltrimethoxysilane (organosilicon compound) | 10.0 parts |

The above materials were mixed and the pH was adjusted to 4.0 by adding 1.0 mol/L hydrochloric acid. Thereafter, the mixture was stirred for 1 h while heating to 60° C. with a water bath to prepare an organosilicon compound liquid 1.

Production Examples of Organosilicon Compound Liquids 2 to 6

Organosilicon compound liquids 2 to 6 were prepared in the same manner as in the production example of the organosilicon compound liquid 1 except that the type of the organosilicon compound was changed as shown in Table 1.

TABLE 1

| Organosilicon compound No. | Name of compound |
|---|---|
| 1 | Methyltriethoxysilane |
| 2 | Propyltrimethoxysilane |
| 3 | Hexyltrimethoxysilane |
| 4 | Tetratriethoxysilane |
| 5 | Dimethyldiethoxysilane |
| 6 | Trimethylethoxysilane |

Production Example of Toner Base Particle-dispersed Solution 1

A total of 14.0 parts of sodium phosphate (dodecahydrate) (manufactured by Rasa Industries, Ltd.) was put in a reaction vessel including 390.0 parts of ion exchanged water, and the components were kept at 65° C. for 1.0 h while purging with nitrogen.

An aqueous solution of calcium chloride prepared by dissolving 9.2 parts of calcium chloride(dihydrate) in 10.0 parts of ion exchanged water was charged all at once into the reaction vessel, while stirring at 12,000 rpm by using T. K. HOMOMIXER (manufactured by Tokushu Kika Kogyo Co., Ltd.), to prepare an aqueous medium including a dispersion stabilizer.

Further, 1.0 mol/L hydrochloric acid was added to the aqueous medium in the reaction vessel, and the pH was adjusted to 6.0 to prepare an aqueous medium 1.

Preparation of Polymerizable Monomer Composition

| | |
|---|---|
| Styrene | 60.0 parts |
| C.I. Pigment Red 122 | 6.0 parts |
| C.I. Pigment Red 150 | 3.6 parts |

The above materials were charged in an attritor (manufactured by Nippon Coke & Engineering Co., Ltd.), and further dispersed with zirconia particles having a diameter of 1.7 mm at 220 rpm for 5.0 h to prepare a colorant-dispersed solution in which the pigments were dispersed.

Next, the following materials were added to the colorant-dispersed solution.

| | |
|---|---|
| Styrene | 10.0 parts |
| n-Butyl acrylate | 30.0 parts |
| Polyester resin (Polycondensate of terephthalic acid and propylene oxide 2 mol adduct of bisphenol A) | 5.0 parts |
| Fischer-Tropsch wax (melting point 70° C.) | 7.0 parts |

The materials were kept at 65° C. and then uniformly dissolved and dispersed at 500 rpm by using T. K. HOMOMIXER to prepare a polymerizable monomer composition.

Granulation Step

The polymerizable monomer composition was charged into the aqueous medium 1 while maintaining the temperature of the aqueous medium 1 at 70° C. and the revolution speed of the stirrer at 12,000 rpm, and 9.0 parts of t-butyl peroxypivalate as a polymerization initiator was added. The mixture was granulated for 10 min while maintaining the revolution speed of the stirrer at 12,000 rpm.

Polymerization Step

The high-speed stirrer was replaced with a stirrer equipped with a propeller stirring blade, polymerization was performed for 5.0 h while maintaining the temperature at 70° C. while stirring at 150 rpm, and a polymerization reaction was further conducted by raising the temperature to 85° C. and heating for 2.0 h. Ion exchanged water was added to adjust the concentration of the toner base particles in the dispersion to 20.0%, and a toner base particle-dispersed solution 1 in which the toner base particles 1 were dispersed was obtained.

The toner base particles 1 had a number average particle diameter (D1) of 5.9 μm and a weight average particle diameter (D4) of 6.5 μm.

Production Example of Toner Base Particle-Dispersed Solution 2

The following materials were mixed in a reaction vessel equipped with a cooling tube, a stirrer, and a nitrogen introduction tube.

| | |
|---|---|
| Terephthalic acid | 29.0 parts |
| Polyoxypropylene (2.2)-2,2-bis(4-hydroxyphenyl)propane | 80.0 parts |
| Titanium dihydroxybis(triethanolaminate) | 0.1 part |

Thereafter, the mixture was heated to 200° C., nitrogen was introduced, and the components were reacted for 9 h while removing the generated water. Further, 5.8 parts of trimellitic anhydride was added, and a polyester resin was synthesized by heating to 170° C. and reacting for 3 h.

Subsequently, the following materials were charged into an autoclave, the interior of the system was replaced with nitrogen, and the temperature was then kept at 180° C. while rising the temperature and stirring.

| | |
|---|---|
| Low-density polyethylene (melting point 100° C.) | 20.0 parts |
| Styrene | 64.0 parts |
| n-Butyl acrylate | 13.5 parts |
| Acrylonitrile | 2.5 parts |

Subsequently, 50.0 parts of a xylene solution of 2.0% t-butyl hydroperoxide was continuously added dropwise to the system over 4.5 h. After cooling, the solvent was separated and removed to obtain a graft polymer in which a styrene-acryl copolymer was grafted onto polyethylene.

The following materials were thoroughly mixed with an FM MIXER (Nippon Coke & Engineering Co., Ltd.) and then melt-kneaded with a twin-screw kneader (manufactured by Ikegai Iron Works Co., Ltd.) set to a temperature of 100° C.

| | |
|---|---|
| Polyester resin | 100.0 parts |
| Fischer-Tropsch wax (melting point 70° C.) | 5.0 parts |
| Graft polymer | 5.0 parts |
| C.I. Pigment Red 122 | 6.0 parts |
| C.I. Pigment Red 150 | 3.6 parts |

The obtained kneaded product was cooled and coarsely pulverized to not more than 1 mm with a hammer mill to obtain a coarsely pulverized product.

Next, the finely pulverized product of about 5 μm was obtained using a turbo mill manufactured by Turbo Kogyo Co., Ltd. to pulverize the coarsely pulverized product, and then toner base particles 2 were obtained by cutting the finely pulverized fraction by using a multi-division classifier utilizing the Coanda effect.

The toner base particles 2 had a number average particle diameter (D1) of 5.6 μm and a weight average particle diameter (D4) of 6.5 μm.

A total of 14.0 parts of sodium phosphate (dodecahydrate) manufactured by Rasa Industries, Ltd.) was put in a reaction vessel including 390.0 parts of ion exchanged water, and the components were kept at 65° C. for 1.0 h while purging with nitrogen.

An aqueous solution of calcium chloride prepared by dissolving 9.2 parts of calcium chloride(dihydrate) in 10.0 parts of ion exchanged water was charged all at once into the reaction vessel, while stirring at 12,000 rpm by using T. K. HOMOMIXER (manufactured by Tokushu Kika Kogyo Co., Ltd.), to prepare an aqueous medium including a dispersion stabilizer.

Further, 1.0 mol/L hydrochloric acid was added to the aqueous medium in the reaction vessel, and the pH was adjusted to 6.0 to prepare an aqueous medium.

A total of 200.0 parts of the toner base particles 2 was added into the aqueous medium, and the particles were dispersed for 15 min at a temperature of 60° C. while rotating T. K. HOMOMIXER at 5000 rpm. Ion exchanged water was then added to adjust the concentration of the toner particle in the dispersion to 20.0% and obtain a toner base particle-dispersed solution 2.

Production Example of Toner Base Particle-dispersed Solution 3

The following materials were weighed, mixed and dissolved.

| | |
|---|---|
| Styrene | 82.6 parts |
| n-Butyl acrylate | 9.2 parts |
| Acrylic acid | 1.3 parts |
| Hexanediol diacrylate | 0.4 part |
| n-Lauryl mercaptan | 3.2 parts |

To this solution, a 10% aqueous solution of NEOGEN RK (manufactured by DKS Co., Ltd.) was added and dispersed. An aqueous solution prepared by dissolving 0.15 part of potassium persulfate in 10.0 parts of ion exchanged water was the added while gently stirring for 10 min.

After nitrogen substitution, emulsion polymerization was carried out at a temperature of 70° C. for 6.0 h. After completion of the polymerization, the reaction liquid was cooled to room temperature, and ion exchange water was added to obtain a resin particle-dispersed solution having a solid fraction concentration of 12.5% and a number average particle diameter of 0.2 μm.

The following materials were weighed and mixed.

| | |
|---|---|
| Ester wax (melting point: 70° C.) | 100.0 parts |
| NEOGEN RK | 15.0 parts |
| Ion exchanged water | 385.0 parts |

The mixture was dispersed for 1 h by using a wet type jet mill JN100 (manufactured by JOKOH) to obtain a wax particle-dispersed solution. The solid fraction concentration of the wax particle-dispersed solution was 20.0%.

The following materials were weighed and mixed.

| | |
|---|---|
| C.I. Pigment Red 122 | 62.5 parts |
| C.I. Pigment Red 150 | 37.5 parts |
| NEOGEN RK | 15.0 parts |
| Ion exchanged water | 885.0 parts |

The mixture was dispersed for 1 h by using the wet type jet mill JN100 to obtain a colorant particle-dispersed solution. The solid fraction concentration of the colorant particle-dispersed solution was 10.0%.

| | |
|---|---|
| Resin particle-dispersed solution | 160.0 parts |
| Wax particle-dispersed solution | 10.0 parts |
| Colorant particle-dispersed solution | 18.9 parts |
| Magnesium sulfate | 0.2 part |

The above materials were dispersed using a homogenizer (manufactured by IKA), and then heated to 65° C. under stirring. After stirring at 65° C. for 1.0 h, observation with an optical microscope confirmed that aggregate particles having a number average particle diameter of 6.0 μm were formed. A total of 2.2 parts of NEOGEN RK (manufactured by DKS Co., Ltd.) was added, the temperature was raised to 80° C. and stirring was performed for 2.0 h to obtain fused colored resin particles.

After cooling, filtration was performed, and the filtered solids were washed with 720.0 parts of ion exchanged water under stirring for 1.0 h. The dispersion including the colored resin was filtered and then dried to obtain toner base particles 3.

The toner base particles 3 had a number average particle diameter (D1) of 6.2 μm and a weight average particle diameter (D4) of 7.1 μm.

A total of 14.0 parts of sodium phosphate (dodecahydrate) (manufactured by Rasa Industries, Ltd.) was put in a reaction vessel including 390.0 parts of ion exchanged water, and the components were kept at 65° C. for 1.0 h while purging with nitrogen.

An aqueous solution of calcium chloride prepared by dissolving 9.2 parts of calcium chloride(dihydrate) in 10.0 parts of ion exchanged water was charged all at once into the reaction vessel, while stirring at 12,000 rpm by using T. K. HOMOMIXER (manufactured by Tokushu Kika Kogyo Co., Ltd.), to prepare an aqueous medium including a dispersion stabilizer.

Further, 1.0 mol/L hydrochloric acid was added to the aqueous medium in the reaction vessel, and the pH was adjusted to 6.0 to prepare an aqueous medium.

A total of 100.0 parts of the toner base particles 3 was added into the aqueous medium, and the particles were dispersed for 15 min at a temperature of 60° C. while rotating T. K. HOMOMIXER at 5000 rpm. Ion exchanged water was then added to adjust the concentration of the toner base particles 3 in the dispersion to 20.0% and obtain a toner base particle-dispersed solution 3.

Production Example of Toner Base Particle-Dispersed Solution 4

A total of 660.0 parts of ion exchanged water and 25.0 parts of 48.5% aqueous solution of sodium dodecyl diphenyl ether disulfonate were mixed and stirred, and then stirred at 10,000 rpm by using T. K. HOMOMIXER (manufactured by Tokushu Kika Kogyo Co., Ltd.) to prepare an aqueous medium.

The following materials were charged into 500.0 parts of ethyl acetate and dissolved in a propeller stirrer at 100 rpm to prepare a solution.

| | |
|---|---|
| Styrene/butyl acrylate copolymer (Copolymerization mass ratio: 80/20) | 100.0 parts |
| Polyester resin (Polycondensate of terephthalic acid and propylene oxide 2 mol adduct of bisphenol A) | 3.0 parts |
| C.I. Pigment Red 122 | 6.0 parts |
| C.I. Pigment Red 150 | 3.6 parts |
| Fischer-Tropsch wax (melting point: 70° C.) | 9.0 parts |

Next, 150.0 parts of the aqueous medium was placed in a vessel, stirring was carried out by using T. K. HOMOMIXER at a revolution speed of 12,000 rpm, 100.0 parts of the solution was added thereto, and mixing was performed for 10 min to prepare an emulsified slurry.

Thereafter, 100.0 parts of the emulsified slurry was charged in a flask equipped with a degassing pipe, a stirrer and a thermometer, the solvent was removed under reduced pressure at 30° C. for 12 h while stirring at a stirring peripheral speed of 20 m/min, and aging was performed at 45° C. for 4 h to prepare a desolvated slurry.

After filtering the desolvated slurry under reduced pressure, 300.0 parts of ion exchanged water was added to the obtained filter cake, followed by mixing and redispersing with T. K. HOMOMIXER (at a revolution speed of 12,000 rpm for 10 min) and then filtration.

The obtained filter cake was dried in a drier at 45° C. for 48 h and sieved with a mesh size of 75 μm to obtain toner base particles 4.

The toner base particles 4 had a number average particle diameter (D1) of 5.7 μm and a weight average particle diameter (D4) of 6.9 μm.

A total of 14.0 parts of sodium phosphate (dodecahydrate) (manufactured by Rasa Industries, Ltd.) was put in a reaction vessel including 390.0 parts of ion exchanged water, and the components were kept at 65° C. for 1.0 h while purging with nitrogen.

An aqueous solution of calcium chloride prepared by dissolving 9.2 parts of calcium chloride(dihydrate) in 10.0 parts of ion exchanged water was charged all at once into the reaction vessel, while stirring at 12,000 rpm by using T. K. HOMOMIXER, to prepare an aqueous medium including a dispersion stabilizer. Further, 1.0 mol/L hydrochloric acid was added to the aqueous medium in the reaction vessel, and the pH was adjusted to 6.0 to prepare an aqueous medium.

A total of 100.0 parts of the toner base particles 4 was added into the aqueous medium, and the particles were dispersed for 15 min at a temperature of 60° C. while rotating T. K. HOMOMIXER at 5000 rpm. Ion exchanged water was then added to adjust the concentration of the toner base particles 4 in the dispersion to 20.0% and obtain a toner base particle-dispersed solution 4.

Production Example of Toner 1

The following materials were weighed in a reaction vessel and mixed using a propeller stirring blade.

| | |
|---|---|
| 44% Aqueous solution of titanium lactate (TC-310: manufactured by Matsumoto Fine Chemical Co., Ltd. corresponding to 0.03 part as titanium lactate) | 0.07 part |
| Toner base particle-dispersed solution 1 | 500.0 parts |

Then, immediately after adjusting the pH of the mixed solution to 5.5 by adding 1.0 mol/L hydrochloric acid, 20.0 parts of the organosilicon compound liquid 1 was added, and a 1.0 mol/L NaOH aqueous solution was added to adjust the pH to 7.0.

After bringing the temperature of the mixed solution to 50° C., the mixture was kept for 1 h while mixing with a propeller stirring blade. Thereafter, the pH was adjusted to 9.5 by using a 1.0 mol/L NaOH aqueous solution, and the temperature was maintained at 50° C. under stirring for 2 h.

After the temperature was lowered to 25° C., the pH was adjusted to 1.5 with 1.0 mol/L hydrochloric acid, followed by stirring for 1 h. Subsequent washing with ion exchanged water and filtration produced toner particle 1. These particles were designated as Toner 1.

The analysis results confirmed that Toner 1 had on the surface an organosilicon condensate including a reaction product (in the form of fine particles) of phosphoric acid and a compound including titanium.

In addition, the average value of the area of the reaction product was 12 $nm^2$, the coefficient of variation of the area of the reaction product was 1.3, and the content of Si element was 1.8 atomic %.

The reaction product of phosphoric acid and the compound including titanium is obtained by reacting titanium lactate (the compound including titanium) with a phosphoric acid ion (polyhydric acid) derived from sodium phosphate or calcium phosphate in an aqueous medium.

Production Examples of Toners 2 to 15 and 17 to 19

Toners 2 to 15 and 17 to 19 were prepared in the same manner as in Production Example 1 of Toner 1, except that the type and addition amount of the organosilicon compound liquid and the compound including the metal element and the type of toner base particle-dispersed solution were changed as shown in Table 2. Physical properties of each toner are shown in Table 2.

Production Example of Toner 16

| | |
|---|---|
| Ion exchanged water | 100.0 parts |
| Sodium carbonate | 1.0 part |

After mixing the above materials, a 44% aqueous solution of titanium lactate (TC-310, manufactured by Matsumoto Fine Chemical Co., Ltd., corresponding to 0.03 part as titanium lactate) was added at room temperature while stirring at 10,000 rpm by using T. K. HOMOMIXER (manufactured by Tokushu Kika Kogyo Co., Ltd.). Then, 1.0 mol/L hydrochloric acid was added to adjust the pH to 7.0.

Thereafter, the solid fraction was taken out by centrifugation. Thereafter, a step of dispersing again in ion exchanged water and taking out the solid fraction by centrifugation was repeated three times to remove ions such as sodium. The resulting product was again dispersed in ion exchanged water and dried by spray drying to obtain a reaction product of carbonic acid and a compound including titanium.

Then, 1.0 mol/L hydrochloric acid was added to the toner base particle-dispersed solution 1 and the pH was adjusted to 1.5 followed by stirring for 1 h. Then, filtration was performed while washing with ion exchanged water, followed by drying with a vacuum dryer. As a result, toner base particles 1 were obtained.

A total of 1.0 part of the reaction product of carbonic acid and the compound including titanium was charged per 100.0 parts of the toner base particles 1 into the device shown in FIG. 1.

Figure 2:
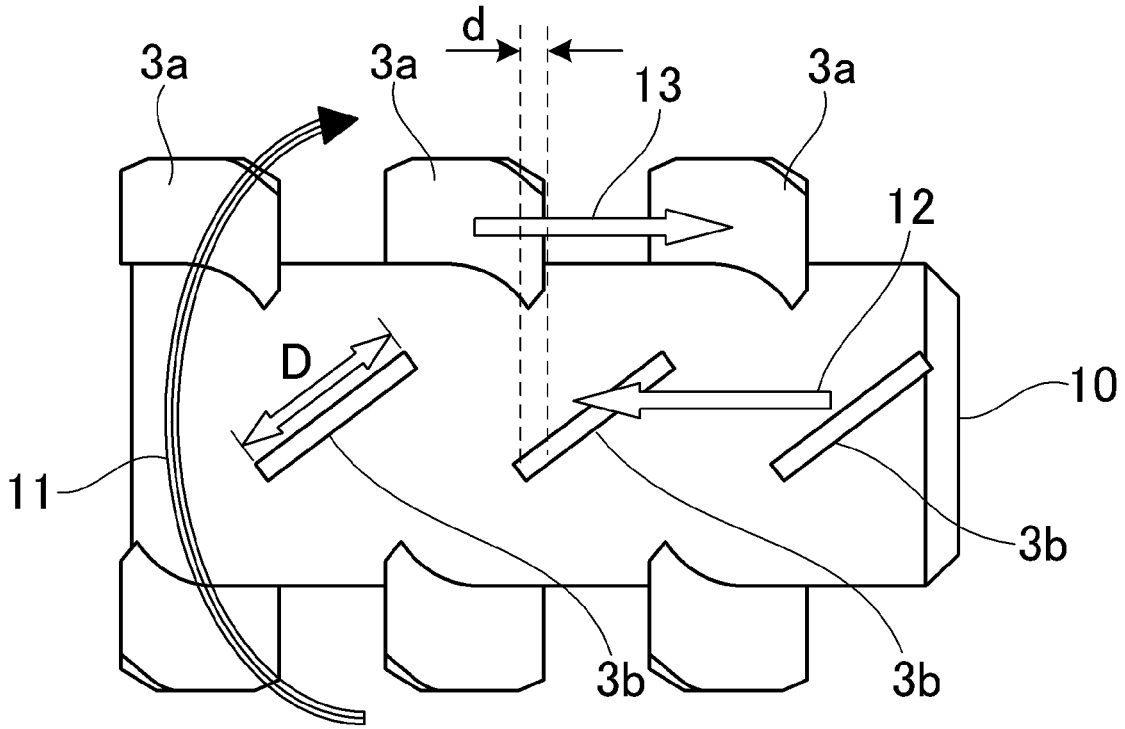
FIG. 2 is a schematic diagram of a stirring member of the mixing process arpparatus.

Here, in FIGS. 1 and 2, reference number 1 represents main body casing, reference number 2 represents rotating member, reference numbers 3, 3*a* and 3*b* represent stirring member, reference number 4 represents jacket, reference number 5 represents raw material inlet port, reference number 6 represents product discharge port, reference number 7 represents rotating axis, reference number 8 represents driving portion, reference number 9 represents treatment space, reference number 10 represents end surface of rotating member, reference number 11 represents direction of rotation, reference number 12 represents back direction, reference number 13 represents forward direction, reference number 16 represents raw material inlet port inner piece, reference number 17 represents product discharge port inner piece, reference symbol d represents overlapping width of stirring member, and reference symbol D represents width of stirring member.

In the device shown in FIG. 1, the diameter of the inner peripheral portion of a main body casing 1 is 130 mm, the volume of a treatment space 9 is $2.0\times10^{-3}$ $m^3$, and the rated power of a driving portion 8 is 5.5 kW. The shape of a stirring member 3 is shown in FIG. 2. The overlapping width d of a stirring member 3*a* and a stirring member 3*b* in FIG. 2 was set 0.25 D with respect to the maximum width D of the stirring member 3 and the clearance between the stirring member 3 and the inner periphery of the main body casing 1 was 6.0 mm.

Next, premixing was carried out in order to mix homogeneously the toner base particles 1 and the reaction product. The conditions of premixing were set such that the peripheral speed of the outermost end portion of the stirring member 3*a* (FIG. 2) was 2.0 m/sec and the treatment time was 1 min.

After completion of premixing, external addition and mixing treatment was carried out. The conditions of the external addition and mixing treatment were set such that the outermost end portion of the stirring member 3*a* was adjusted to 10 m/sec and the treatment time was set to 5 min. After the external addition and mixing treatment, coarse particles and the like were removed with a circular vibration sieve equipped with a screen having a diameter of 500 mm and a sieve opening of 75 μm to obtain toner base particles 16 to which the reaction product was attached.

Meanwhile, 14.0 parts of sodium phosphate (dodecahydrate) (manufactured by Rasa Industries, Ltd.) was put in a reaction vessel including 390.0 parts of ion exchanged water, and the components were kept at 65° C. for 1.0 h while purging with nitrogen.

An aqueous solution of calcium chloride prepared by dissolving 9.2 parts of calcium chloride(dihydrate) in 10.0 parts of ion exchanged water was charged all at once into the reaction vessel, while stirring at 12,000 rpm by using T. K. HOMOMIXER (manufactured by Tokushu Kika Kogyo Co., Ltd.), to prepare an aqueous medium including a dispersion stabilizer.

Further, 1.0 mol/L hydrochloric acid was added to the aqueous medium in the reaction vessel, and the pH was adjusted to 6.0 to prepare an aqueous medium.

A total of 100.0 parts of the toner base particles 16 was added into the aqueous medium, and the particles were dispersed for 15 min at a temperature of 60° C. while rotating T. K. HOMOMIXER at 5000 rpm. Ion exchanged water was then added to adjust the concentration of the toner particle in the dispersion to 20.0% and obtain a toner base particle-dispersed solution 16.

After 1.0 mol/L hydrochloric acid was added to 500.0 parts of the toner base particle-dispersed solution 16 to adjust the pH of the mixed solution to 5.5, 20.0 parts of the organosilicon compound liquid 6 was added, and the pH was adjusted to 7.0 with 1.0 mol/L NaOH aqueous solution. After bringing the temperature of the mixed solution to 50° C., the mixture was kept for 1 h while mixing with a propeller stirring blade.

Thereafter, the pH was adjusted to 9.5 by using a 1.0 mol/L NaOH aqueous solution, and the temperature was maintained at 50° C. under stirring for 2 h.

After the temperature was lowered to 25° C., the pH was adjusted to 1.5 with 1.0 mol/L hydrochloric acid, followed by stirring for 1 h. Subsequent washing with ion exchanged water and filtration produced toner particle 16. These particles were designated as Toner 16.

The analysis results confirmed that Toner 16 had on the surface an organosilicon condensate including a reaction product (in the form of fine particles) of carbonic acid and a compound including titanium.

The average value of the area of the reaction product, the coefficient of variation of the area of the reaction product, and the content of Si element are shown in Table 2.

Production Example of Toner 20

Toner 20 was obtained in the same manner as in the Production Example of Toner 1, except that the type and addition amount of the organosilicon compound liquid and the compound including the metal element and the type of toner base particle-dispersed solution were changed as shown in Table 2 and also except that the addition timing of the organosilicon compound liquid was changed immediately after the pH was adjusted to 9.5.

The average value of the area of the reaction product, the coefficient of variation of the area of the reaction product, and the content of Si element are shown in Table 2.

Production Example of Toner 21

Toner 21 was obtained in the same manner as in the Production Example of Toner 1, except that the type and addition amount of the organosilicon compound liquid and the compound including the metal element and the type of toner base particle-dispersed solution were changed as shown in Table 2 and also except that the addition timing of the organosilicon compound liquid was changed to 0.5 h after the pH was adjusted to 9.5.

The average value of the area of the reaction product, the coefficient of variation of the area of the reaction product, and the content of Si element are shown in Table 2.

TABLE 2

| Toner No. | Toner base particle-dispersed solution No. | Organosilicon compound Type No. | Organosilicon compound Addition amount (parts) | Compound including metal element Type | Compound including metal element Addition amount (parts) | Toner measurement results A | Toner measurement results B | Toner measurement results C |
|---|---|---|---|---|---|---|---|---|
| 1 | 1 | 1 | 20.0 | Titanium lactate | 0.03 | 12 | 1.3 | 1.8 |
| 2 | 2 | 1 | 20.0 | Titanium lactate | 0.07 | 48 | 1.7 | 2.0 |
| 3 | 3 | 1 | 20.0 | Titanium lactate | 0.17 | 104 | 2.1 | 1.8 |
| 4 | 4 | 1 | 20.0 | Titanium lactate | 0.33 | 298 | 3.0 | 2.1 |
| 5 | 1 | 1 | 20.0 | Titanium lactate | 0.66 | 1027 | 4.2 | 1.9 |
| 6 | 1 | 1 | 20.0 | Titanium lactate | 0.33 | 521 | 2.4 | 2.1 |
| 7 | 1 | 2 | 5.0 | Titanium lactate | 0.33 | 510 | 2.0 | 2.0 |
| 8 | 1 | 3 | 5.0 | Titanium lactate | 0.33 | 503 | 1.7 | 2.2 |
| 9 | 1 | 1 | 100.0 | Titanium lactate | 3.30 | 2485 | 2.3 | 19.4 |
| 10 | 1 | 1 | 50.0 | Titanium lactate | 1.65 | 2015 | 1.8 | 10.8 |
| 11 | 1 | 1 | 30.0 | Titanium lactate | 0.66 | 1081 | 2.1 | 5.2 |
| 12 | 1 | 1 | 18.0 | Titanium lactate | 0.33 | 513 | 2.4 | 0.9 |

TABLE 2-continued

| Toner No. | Toner base particle-dispersed solution No. | Organosilicon compound Type No. | Organosilicon compound Addition amount (parts) | Compound including metal element Type | Compound including metal element Addition amount (parts) | Toner measurement results A | B | C |
|---|---|---|---|---|---|---|---|---|
| 13 | 1 | 1 | 15.0 | Titanium lactate | 0.33 | 487 | 2.0 | 0.4 |
| 14 | 1 | 4 | 20.0 | Titanium lactate | 0.33 | 2108 | 3.9 | 7.0 |
| 15 | 1 | 5 | 20.0 | Titanium lactate | 0.33 | 481 | 3.0 | 2.4 |
| 16 | 1 | 6 | 20.0 | Titanium lactate (*1) | — | 2571 | 4.8 | 5.0 |
| 17 | 1 | 6 | 20.0 | Zirconium lactate ammonium salt | 0.33 | 508 | 2.5 | 1.7 |
| 18 | 1 | 1 | 20.0 | Aluminum lactate | 0.33 | 476 | 2.8 | 1.9 |
| 19 | 1 | 1 | 20.0 | Copper lactate | 0.33 | 510 | 4.1 | 2.0 |
| 20 | 1 | 1 | 20.0 | Titanium lactate | 0.33 | 2959 | 6.8 | 2.4 |
| 21 | 1 | 1 | 20.0 | Titanium lactate | 0.33 | 4875 | 9.8 | 1.8 |

In the table,

A represents the average value ($nm^2$) of the area of the reaction product,

B represents the coefficient of variation of the area of the reaction product,

C represents the content (atomic %) of Si element on the toner particle surface.

The addition amount of the compound including the metal element indicates the amount of the compound actually added.

Also, *1 indicates that the compound was added as a solid fraction of titanium lactate.

Production Example of Comparative Toner 1

The following materials were weighed in a reaction vessel and mixed at 10,000 rpm by using T. K. HOMOMIXER (manufactured by Tokushu Kika Kogyo Co., Ltd.).

| | |
|---|---|
| Titanium oxide (volume average particle diameter: 15 nm) | 1.0 part |
| Toner base particle-dispersed solution 1 | 500.0 parts |

Immediately after adjusting the pH of the mixed solution to 5.5 by adding 1.0 mol/L hydrochloric acid, 20.0 parts of the organosilicon compound liquid 1 was added, and a 1.0 mol/L NaOH aqueous solution was used to adjust the pH to 7.0.

After bringing the temperature of the mixed solution to 50° C., the mixture was kept for 1 h while mixing with a propeller stirring blade. Thereafter, the pH was adjusted to 9.5 by using a 1.0 mol/L NaOH aqueous solution, and the temperature was maintained at 50° C. under stirring for 2 h.

After the temperature was lowered to 25° C., the pH was adjusted to 1.5 with 1.0 mol/L hydrochloric acid, followed by stirring for 1 h. Subsequent washing with ion exchanged water and filtration produced comparative toner particle 1. These particles were designated as Comparative Toner 1.

The analysis results confirmed that Comparative Toner 1 had on the surface an organosilicon condensate including titanium oxide.

The average value of the area of titanium oxide was 2569 $nm^2$, the coefficient of variation of the area of titanium oxide was 5.4, and the content of Si element was 2.2 atomic %.

Production Example of Comparative Toner 2

The following materials were weighed in a reaction vessel and mixed at 10,000 rpm by using T. K. HOMOMIXER (manufactured by Tokushu Kika Kogyo Co., Ltd.).

| | |
|---|---|
| 44% Aqueous solution of titanium lactate (TC-310: manufactured by Matsumoto Fine Chemical Co., Ltd. corresponding to 0.08 part as titanium lactate) | 0.19 part |
| Toner base particle-dispersed solution 1 | 500.0 parts |

Then, the pH was adjusted to 9.5 by using a 1.0 mol/L NaOH aqueous solution, and the temperature was maintained at 90° C. under stirring for 2 h.

After the temperature was lowered to 25° C., the pH was adjusted to 1.5 with 1.0 mol/L hydrochloric acid, followed by stirring for 1 h. Subsequent washing with ion exchanged water and filtration produced comparative toner particle 2. These particles were designated as Comparative Toner 2.

The analysis results confirmed that Comparative Toner 2 had on the surface a reaction product of phosphoric acid and a compound including titanium.

The average value of the area of the reaction product was 480 $nm^2$ and the coefficient of variation of the area of the reaction product was 2.3. Meanwhile, Si element was not detected on the surface of the toner particle.

Production Example of Comparative Toner 3

The following materials were charged into a reaction vessel equipped with a cooling tube, a stirrer, and a nitrogen introduction tube.

| | |
|---|---|
| Bisphenol A propylene oxide 2 mol adduct | 148.0 parts |
| Bisphenol A propylene oxide 3 mol adduct | 43.2 parts |
| Isophthalic acid | 47.2 parts |
| Adipic acid | 17.8 parts |

Thereafter, the components were reacted together with 500 ppm of titanium tetraisopropoxide at 230° C. for 10 h under atmospheric pressure. Subsequently, 26.0 parts of benzoic acid was added to the reaction vessel, and the reaction was conducted under a reduced pressure of 10 mmHg for 5 h. Thereafter, 11.0 parts of trimellitic anhydride was added to the reaction vessel, and the reaction was conducted at 180° C. under atmospheric pressure for 3 h to obtain a polyester resin 1.

The following materials were charged into a reaction vessel equipped with a cooling tube, a stirrer, and a nitrogen introduction tube.

| | |
|---|---|
| Bisphenol A propylene oxide 2 mol adduct | 96.6 parts |
| Bisphenol A propylene oxide 3 mol adduct | 28.2 parts |
| Isophthalic acid | 19.4 parts |
| Fumaric acid | 13.6 parts |
| Terephthalic acid | 9.7 parts |

Thereafter, the components were reacted together with 500 ppm of titanium tetraisopropoxide at 230° C. for 10 h under atmospheric pressure. Subsequently, after conducting the reaction under a reduced pressure of 10 mmHg for 5 h, 15.0 parts of trimellitic anhydride was placed in a reaction vessel and the reaction was conducted at 180° C. under atmospheric pressure for 3 h to obtain a polyester resin 2.

The following materials were thoroughly mixed with an FM MIXER (Nippon Coke & Engineering Co., Ltd.), and then melt-kneaded with a twin-screw kneader (manufactured by Ikegai Iron Works Co., Ltd.) set to a temperature of 130° C.

| | |
|---|---|
| Polyester resin 1 | 90.4 parts |
| Polyester resin 2 | 9.6 parts |
| Fischer-Tropsch wax (melting point 70° C.) | 5.0 parts |
| Bontron E-84 | 1.0 part |
| C.I. Pigment Red 122 | 5.7 parts |
| C.I. Pigment Red 150 | 3.4 parts |

The obtained kneaded product was cooled and coarsely pulverized to not more than 1 mm with a hammer mill to obtain a coarsely pulverized product.

Next, the finely pulverized product of about 5 μm was obtained using a turbo mill manufactured by Turbo Kogyo Co., Ltd. to pulverize the coarsely pulverized product, and then toner base particles 5 were obtained by cutting the finely pulverized fraction by using a multi-division classifier utilizing the Coanda effect. The toner base particles 5 had a number average particle diameter (D1) of 5.2 μm and a weight average particle diameter (D4) of 6.1 μm.

Next, 1.1 parts of hydrophobic silica (NY50: manufactured by Nippon Aerosil Co., Ltd.) having a volume average particle diameter of 30 nm and 1.0 part of hydrophobic silica (X-24-9163A: manufactured by Shin-Etsu Chemical Co., Ltd.) having a volume average particle size of 100 nm were added to 100.0 parts of the toner base particles 5.

The components were then mixed with an FM MIXER (manufactured by Nippon Coke & Engineering Co., Ltd.) at a peripheral speed of 32 m/s for 10 min, and coarse particles were removed with a mesh having an opening of 45 μm to obtain Comparative Toner 3.

Production Example of Comparative Toner 4

A total of 1.1 parts of hydrophobic silica (NY50: manufactured by Nippon Aerosil Co., Ltd.) having a volume average particle diameter of 30 nm and 1.0 part of hydrophobic silica (X-24-9163A: manufactured by Shin-Etsu Chemical Co., Ltd.) having a volume average particle size of 100 nm were added to 100.0 parts of the toner base particles 1.

The components were then mixed with an FM MIXER (manufactured by Nippon Coke & Engineering Co., Ltd.) at a peripheral speed of 32 m/s for 10 min, and coarse particles were removed with a mesh having an opening of 45 μm to obtain Comparative Toner 4.

Production Example of Reaction Product Fine Particles 1

| | |
|---|---|
| Ion exchanged water | 100.0 parts |
| Sodium phosphate (dodecahydrate) (manufactured by Rasa Industries, Ltd.) | 8.5 parts |

The components listed above were mixed, and then 10.0 parts of a 44% aqueous solution of titanium lactate (TC-310, Matsumoto Fine Chemical Co., Ltd.) was added while stirring at 10,000 rpm at room temperature by using T. K. HOMOMIXER (manufactured by Tokushu Kika Kogyo Co., Ltd.). Then, 1 mol/L hydrochloric acid was added to adjust the pH to 7.0.

Thereafter, the solid fraction was taken out by centrifugation, and then a step of dispersing again in ion exchanged water and taking out the solid fraction by centrifugation was repeated three times to remove ions such as sodium. The resulting product was again dispersed in ion exchanged water and dried by spray drying to obtain reaction product fine particles 1 of phosphoric acid and a compound including a titanium element. The particles had a number average particle diameter of 310 nm.

Production Example of Comparative Toner 5

A total of 4.0 parts of the reaction product fine particles 1 were added to 100.0 parts of the toner base particles 1.

The components were then mixed with an FM MIXER (manufactured by Nippon Coke & Engineering Co., Ltd.) at a peripheral speed of 32 m/s for 10 min, and coarse particles were removed with a mesh having an opening of 45 μm to obtain Comparative Toner 5.

Production Example of Comparative Toner 6

A total of 4.0 parts of the reaction product fine particles 1 were charged per 100.0 parts of the toner base particles 1 into the device shown in FIG. 1.

In the device shown in FIG. 1, the diameter of the inner peripheral portion of the main body casing 1 is 130 mm, the volume of the treatment space 9 is $2.0\times10^{-3}$ $m^3$, and the rated power of the driving portion 8 is 5.5 kW. The shape of the stirring member 3 is shown in FIG. 2. The overlapping width d of the stirring member 3*a* and the stirring member 3*b* in FIG. 2 was set 0.25 D with respect to the maximum width D of the stirring member 3 and the clearance between the stirring member 3 and the inner periphery of the main body casing 1 was 6.0 mm.

Next, premixing was carried out in order to mix homogeneously the toner base particles 1 and the reaction product fine particles 1. The conditions of premixing were set such that the peripheral speed of the outermost end portion of the stirring member 3*a* (FIG. 2) was 2.0 m/sec and the treatment time was 1 min.

After completion of premixing, external addition and mixing treatment was carried out. The conditions of the external addition and mixing treatment were set such that the outermost end portion of the stirring member 3*a* was adjusted to 10 m/sec and the treatment time was set to 5 min. After the external addition and mixing treatment, coarse particles and the like were removed with a circular vibration sieve equipped with a screen having a diameter of 500 mm and a sieve opening of 75 μm to obtain Comparative Toner 6.

Physical properties of each comparative toner are shown in Table 3.

TABLE 3

| Comparative toner No. | Toner measurement results A | B | C |
|---|---|---|---|
| 1 | 2569 (Titanium oxide) | 5.4 (Titanium oxide) | 2.2 |
| 2 | 480 | 2.3 | Not detected |
| 3 | 4564 (Silica) | 11.4 (Silica) | Not detected |
| 4 | 4684 (Silica) | 11.2 (Silica) | Not detected |
| 5 | 5868 | 12.4 | Not detected |
| 6 | 5148 | 6.5 | Not detected |

In the table,

A represents the average value ($nm^2$) of the area of the reaction product,

B represents the coefficient of variation of the area of the reaction product.

However, when the reaction product is not used, the value of titanium oxide or silica is presented.

C represents the content (atomic %) of Si element on the toner particle surface.

Examples 1 to 21, Comparative Examples 1 to 6

Using the Toners 1 to 21 and the Comparative Toners 1 to 6, the following evaluations were carried out.

A modified apparatus obtained by modifying a commercially available color laser printer "LBP-712Ci (manufactured by Canon)" so that the process speed was 300 mm/sec was used as an image forming apparatus.

Further, |Vd−Vdc| (Vback) which is the potential difference between a dark potential (Vd) on a photosensitive member and a potential (Vdc) applied to a developing roller was lowered to 100 V by adjusting Vdc.

Thereafter, the toner of the magenta cartridge was taken out, and 120 g of each of Toners 1 to 21 and Comparative Toners 1 to 4 were filled in this cartridge. After that, the following evaluation was performed.

Evaluation of Toner Scattering

The cartridge was installed to the magenta station of the printer, and one image of a chart with a print percentage of 5% was outputted by using an A4-sized plain paper office 70 (70 $g/m^2$, manufactured by Canon Marketing Japan) under a normal-temperature and normal-humidity environment (temperature 23° C., humidity 60% RH).

Thereafter, the presence or absence of toner contamination in the machine was visually checked every time 1000 images were outputted by repeating the operation of outputting 2 prints and stopping for 10 sec, while replenishing the toner.

Toner scattering was evaluated according to the following criteria by taking the number of outputted prints at which toner contamination occurred in the machine as an index. The results are shown in Table 4.

A: no toner contamination in the machine occurred by 10,000 prints

B: toner contamination in the machine occurred by 10,000 prints

C: toner contamination in the machine occurred by 5000 prints

D: toner contamination in the machine occurred by 2000 prints

Evaluation of Fogging

The cartridge was attached to the magenta station of the printer, and it was confirmed that Vback was 100 V. Thereafter, one full-white image with a print percentage of 0% was outputted by using an A4-sized plain paper office 70 (70 $g/m^2$, manufactured by Canon Marketing Japan) under a normal-temperature and normal-humidity environment (temperature 23° C., humidity 60% RH).

Subsequently, 1000 images with a print percentage of 0.5% were continuously outputted on the printing paper under the normal-temperature and normal-humidity environment, and then a full-white image with a print percentage of 0% was outputted on the evaluation paper.

Measurement of fogging density (%) was carried out by using REFLECT METER MODEL TC-6 DS (manufactured by Tokyo Denshoku Co., Ltd.) and calculating the fogging density (%) from a difference between the whiteness of the white background portion of the full-white image after output of 1000 prints and the whiteness of the full-white image after output of 1 print.

Filters were evaluated by the following criteria using an amber filter. The results are shown in Table 4.

A: fogging density less than 0.5%

B: fogging density of not less than 0.5% and less than 1.0%

C: fogging density of not less than 1.0% and less than 2.0%

D: fogging density of not less than 2.0%

Evaluation of Charge Rising Performance and Charge Rising Performance Maintenance The process cartridge was mounted on the magenta station of the printer and allowed to stand together with A4 size plain paper office 70 (70 $g/m^2$ manufactured by Canon Marketing Japan) for 48 h in a low-temperature and low-humidity environment (15° C./10% RH, hereinafter referred to as L/L environment).

Thereafter, the laid-on level of the full-black image portion on the paper was adjusted to 0.40 mg/cm'.

In the L/L environment, an image having a horizontal band image portion having a length of 10 mm from the position of 10 mm from the top of the paper when viewing the paper vertically, a full-white image portion (laid-on level of 0.00 $mg/cm^2$) having a length of 10 mm in the downstream direction from the horizontal band image portion, and a halftone image portion (laid-on level of 0.20 $mg/cm^2$) having a length of 100 mm further downstream from the full-white image portion was outputted.

The charge rising performance was evaluated based on the following criteria from a difference between the image density of a portion which is downstream of the full-black image portion by one full circumference of the developing roller on the halftone image portion and the image density of a portion which is downstream of the full-white image portion by one full circumference of the developing roller on the halftone image portion.

The image density was measured by measuring the relative density with respect to the image of the white background portion with an image density of 0.00 by using Macbeth reflection densitometer RD918 (manufactured by Macbeth Co.) equipped with an amber filter (initial evaluation). The measurement was performed according to the attached instruction manual. The obtained relative density was taken as the value of image density. The results are shown in Table 4.

When the rise-up of charging is good, the toner supplied onto the charging roller is quickly charged, so that the image density after the full-black image portion and the image density after the full-white image portion does not change and a good image is obtained.

Further, after evaluating the charge rising performance, 25,000 prints of images with a print percentage of 0.5% were continuously outputted on the evaluation paper under a normal-temperature and normal-humidity environment (temperature 23° C., humidity 60% RH). After the printer was allowed to stand for 24 h in the same environment, measurements were carried out in the same manner as in the evaluation of the charge rising performance and the evaluation was carried out according to the same evaluation criteria (this evaluation is an evaluation after durability, that is, evaluation of charge rising performance maintenance).

A: image density difference is less than 0.06

B: image density difference is not less than 0.06 and less than 0.12

C: image density difference is not less than 0.12 and less than 0.20

D: image density difference is not less than 0.20

Evaluation of Color Reproducibility

The cartridge was mounted on the magenta station of the printer and allowed to stand together with A4 size plain paper office 70 (manufactured by Canon Marketing Japan, 70 g/m$^2$) for 48 h under normal-temperature and normal-humidity environment (temperature 23° C., humidity 60% RH). One image pattern in which nine full-black dot images of 10 mm×10 mm were evenly arranged on the paper was outputted. Chroma (C*) on the obtained full-black image was measured using "Spectrolino" (manufactured by Macbeth Co.) according to the attached instruction manual. The average of the chroma of the obtained 9 dots was taken as the chroma value, and the color reproducibility was evaluated according to the following criteria. The results are shown in Table 4.

A: chroma is not less than 74

B: chroma is less than 74

TABLE 4

| | Toner No. | Toner scattering | Fogging | | Charge rising performance Initial | | After durability | | Chroma (C*) | |
|---|---|---|---|---|---|---|---|---|---|---|
| Example 1 | 1 | A | A | 0.1 | A | 0.02 | A | 0.03 | A | 78 |
| Example 2 | 2 | A | A | 0.2 | A | 0.02 | A | 0.04 | A | 78 |
| Example 3 | 3 | A | A | 0.2 | A | 0.03 | A | 0.03 | A | 79 |
| Example 4 | 4 | A | A | 0.2 | A | 0.01 | A | 0.02 | A | 79 |
| Example 5 | 5 | A | A | 0.2 | A | 0.02 | A | 0.03 | A | 78 |
| Example 6 | 6 | A | A | 0.1 | A | 0.01 | A | 0.02 | A | 78 |
| Example 7 | 7 | A | A | 0.3 | A | 0.04 | A | 0.05 | A | 78 |
| Example 8 | 8 | A | A | 0.4 | B | 0.10 | B | 0.11 | A | 80 |
| Example 9 | 9 | A | A | 0.2 | A | 0.04 | B | 0.09 | A | 79 |
| Example 10 | 10 | A | A | 0.2 | A | 0.03 | B | 0.06 | A | 81 |
| Example 11 | 11 | A | A | 0.1 | A | 0.02 | A | 0.03 | A | 79 |
| Example 12 | 12 | A | B | 0.6 | A | 0.02 | B | 0.07 | A | 81 |
| Example 13 | 13 | A | C | 1.0 | A | 0.01 | C | 0.18 | A | 79 |
| Example 14 | 14 | A | A | 0.1 | A | 0.02 | B | 0.09 | A | 79 |
| Example 15 | 15 | A | A | 0.2 | A | 0.02 | B | 0.07 | A | 78 |
| Example 16 | 16 | A | A | 0.4 | A | 0.05 | C | 0.19 | A | 79 |
| Example 17 | 17 | A | A | 0.2 | A | 0.02 | A | 0.02 | A | 78 |
| Example 18 | 18 | A | A | 0.3 | A | 0.05 | A | 0.05 | A | 78 |
| Example 19 | 19 | A | A | 0.4 | C | 0.12 | C | 0.19 | A | 80 |
| Example 20 | 20 | A | A | 0.2 | A | 0.01 | B | 0.11 | A | 78 |
| Example 21 | 21 | A | A | 0.3 | A | 0.01 | C | 0.17 | A | 80 |
| Comparative Example 1 | Comparative Toner 1 | A | B | 0.7 | C | 0.16 | D | 0.25 | A | 80 |
| Comparative Example 2 | Comparative Toner 2 | B | C | 1.4 | C | 0.19 | D | 0.24 | A | 78 |
| Comparative Example 3 | Comparative Toner 3 | A | C | 1.3 | B | 0.07 | D | 0.20 | B | 71 |
| Comparative Example 4 | Comparative Toner 4 | D | D | 2.3 | D | 0.25 | D | 0.39 | A | 78 |
| Comparative Example 5 | Comparative Toner 5 | C | C | 1.1 | B | 0.06 | D | 0.42 | A | 80 |
| Comparative Example 6 | Comparative Toner 6 | B | B | 0.8 | B | 0.06 | D | 0.21 | A | 79 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-011298, filed Jan. 26, 2018, which is hereby incorporated by reference herein in its entirety.

What is claimed is:

1. A toner comprising a toner particle, said toner particle comprising a binder resin and having a layer comprising an organosilicon condensate present on a surface of the toner particle;

the layer comprising the organosilicon condensate further comprising a reaction product of a polyhydric acid and a compound comprising at least one metal element selected from all the metal elements belonging to Groups 3 to 13, wherein in a backscattered electron image of the toner captured at a magnification of 50,000 times using a scanning electron microscope, an average value of an area of the reaction product is 10 to 5000 nm$^2$, and a coefficient of variation of the area of the reaction product is not more than 10.0.

2. The toner according to claim 1, wherein the average value of the area of the reaction product is 10 to 2000 $nm^2$.

3. The toner according to claim 1, wherein a Pauling electronegativity of the metal element is 1.25 to 1.85.

4. The toner according to claim 1, wherein the layer comprising the organosilicon condensate comprises a fine particle comprising a reaction product of a polyhydric acid and a compound comprising at least one metal element selected from all the metal elements belonging to Groups 3 to 13.

5. The toner according to claim 1, wherein the organosilicon condensate is a condensate of at least one organosilicon compound represented by $Ra_{(n)}$-Si-$Rb_{(4-n)}$ where Ra independently represents a halogen atom or an alkoxy group, Rb independently represents an alkyl group, an alkenyl group, an acyl group, an aryl group or a methacryloxyalkyl group, and n represents an integer of 2 to 4.

6. The toner according to claim 5, wherein Rb independently represents an alkyl group having 1 to 6 carbon atoms.

7. The toner according to claim 1, wherein a content of a Si element on the toner particle surface measured by X-ray photoelectron spectroscopy is 0.1 to 40.0 atomic %.

8. The toner according to claim 1, wherein the polyhydric acid is at least one selected from the group consisting of phosphoric acid and carbonic acid.

9. The toner according to claim 1, wherein the reaction product is at least one selected from the group consisting of:

a reaction product of phosphoric acid and a compound including titanium, a reaction product of phosphoric acid and a compound including zirconium, a reaction product of carbonic acid and a compound including titanium, and a reaction product of carbonic acid and a compound including zirconium.

* * * * *